US006457779B1

(12) United States Patent
Busley et al.

(10) Patent No.: US 6,457,779 B1
(45) Date of Patent: Oct. 1, 2002

(54) DEVICE FOR MILLING GROUND SURFACES, SPECIALLY ROADWAYS

(75) Inventors: Peter Busley; Olaf Gaertner, both of Linz; Herbert Ley, Katharinen, all of (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/647,212

(22) PCT Filed: Mar. 19, 1999

(86) PCT No.: PCT/EP99/01834

§ 371 (c)(1),
(2), (4) Date: Sep. 28, 2000

(87) PCT Pub. No.: WO99/50504

PCT Pub. Date: Oct. 7, 1999

(30) Foreign Application Priority Data

Mar. 30, 1998 (DE) ..... 198 14 053

(51) Int. Cl.[7] ..... E01C 23/09
(52) U.S. Cl. ..... 299/39.2; 299/39.5; 299/39.6
(58) Field of Search ..... 404/90, 91, 93, 404/94; 299/39.2, 39.4, 39.5, 39.6; 198/309, 318

(56) References Cited

U.S. PATENT DOCUMENTS 4,186,968 A * 2/1980 Barton ..... 299/39.2
4,193,636 A * 3/1980 Jakob ..... 299/39.2
4,647,248 A * 3/1987 Wirtgen ..... 404/90
4,723,867 A * 2/1988 Wirtgen ..... 404/90
5,441,361 A * 8/1995 Campbell ..... 404/90
5,577,808 A * 11/1996 Gilbert ..... 299/39.2
6,296,318 B1 * 10/2001 Simons et al. ..... 299/39.2

FOREIGN PATENT DOCUMENTS

DE 3903482 A1 2/1989

* cited by examiner

*Primary Examiner*—Heather Shackelford
*Assistant Examiner*—John Kreck
(74) *Attorney, Agent, or Firm*—Diller, Ramik & Wight

(57) ABSTRACT

A device for milling off ground surfaces, especially roadways In a device for milling off ground surfaces (2), especially roadways, comprising a track assembly (4) supporting a machine frame (6), a rolling mill (8) supported in the machine frame (6) and extending transverse to the traveling direction, at least one conveying means (10) arranged in the traveling direction in front of the milling roll (8), for transporting away the milled off material, and a roll casing (18) with a passage opening (22) for the milled of material, facing the conveying means (10), it is provided that the end of the conveying means (10) at the milling roll is supported in a belt shoe (16) fixed at the machine frame (6) so as to be vertically adjustable, and wherein the belt shoe (16) and the conveying means (10) form a rigid unit that cannot be pivoted in relation to each other.

23 Claims, 4 Drawing Sheets

DEVICE FOR MILLING GROUND SURFACES, SPECIALLY ROADWAYS

BACKGROUND OF THE INVENTION

The invention refers to a device for milling off ground surfaces, especially roadways.

Such devices are also called front loader milling machines. Such a front loader milling machine is known from DE 39 03 482 A1, for example. The known milling machines have a self-propelled track assembly with a pair of front wheels and a pair of rear wheels. The track assembly carries a machine frame in which a milling roll is supported transverse to the direction of motion. In order to transport away possibly all of the milled off material, the milling roll is generally enclosed by a casing where the wall directed in the traveling direction is designed as a covering shield with a passage opening for the milled off material. The material worked off by the milling roll is thrown onto a first conveyor belt by the milling roll, the band conveying the worked off material onto a discharge band at the end of the milling machine, which discharge band can be tilted and pivoted to the sides for discharge onto the floor of a truck.

The milling roll is equipped with chiseling tools forming a conveyor helix that transports the milled off material to the passage opening of the covering shield.

The first conveyor belt in front of the milling roll is easily damaged by breaking ground plates, the repair of the conveyor belt requiring the disassembly of the conveying means. Disassembling and mounting the conveying means is rather troublesome and time-consuming. Moreover, several people are needed for this work.

SUMMARY OF THE INVENTION

It is the object of the invention to develop a device of the type mentioned above such that the risk of troubles is substantially reduced.

Advantageously, the invention provides that the end of the conveying means at the milling roll is supported in a belt shoe mounted for vertical adjustment at the machine frame, and that the belt shoe and the conveying means form a rigid unit that cannot be pivoted in relation to each other. The belt shoe and the conveying means can thus not move relative to each other, whereby no worked off material can get jammed between the belt shoe and the conveying means. In this manner, the risk of trouble that would require the disassembly of the conveying means is reduced substantially. The belt shoe is pivoted relative to the machine frame together with the rear end of the conveying means supported in the shoe.

Preferably, the conveying means is removably supported in the rear part of the belt shoe facing the milling roll, the position of the belt shoe relative to the conveying means being fixed by the support of the conveying means and by at least one connecting strut between the belt shoe and the conveying means. The connecting strut makes sure that the belt shoe cannot move in relation to the conveying means.

At least one piston-cylinder unit is provided a lifting means between the machine frame and the belt shoe. By means of this piston-cylinder unit, the belt shoe can be lifted vertically to surmount obstacles, for example. The piston-cylinder unit cannot push the belt shoe down, but only lift it when desired. Furthermore, the belt shoe can move up freely together with the conveying means.

In a preferred embodiment, it is provided that upon vertical adjustment, two hingedly connected connecting rods guide the belt shoe with the rear end of the conveying means, the first connecting rod being hinged to the belt shoe and the second connecting rod being hinged to the machine frame. When lifting the belt shoe, the connecting rods provide for an exact guiding of the unit formed by the belt shoe and the conveying means. Here, the unit is pivoted about the bearing point of the conveying means in the shaft of the machine frame.

Preferably, it is provided that the connecting rods and/or the connecting strut are arranged on both sides of the belt shoe. The double arrangement of the connecting rods and the connecting strut on both sides of the belt shoe causes an exact guiding of the rear end of the conveying means and the belt shoe along a predetermined path. The double arrangement of the connecting strut increases the torsional rigidity of the unit formed by the belt shoe and the conveying means.

With connecting rods supported on both sides of the machine frame, it is preferably provided that the connecting rods hinged to the machine frame are coupled via a linking rod. The linking rod synchronizes the movement of the connecting rods on both sides so that an exact parallel guiding of the belt shoe with the rear end of the conveying means is guaranteed.

The connecting rod may be bent like a toggle lever, the linking rod being supported in the toggle portion. Supporting the linking rod in the toggle portion improves the force transmission because of the leverage.

The belt shoe is provided with a transverse protective shield for protecting the conveyor belt of the conveying means. The protective shield prevents sharp-edged material from damaging the conveyor belt.

The roll casing has stops for the lowest and/or frontmost position of the belt shoe. The stop for the lowest position of the belt shoe limits the downward pivoting movement of the unit formed by the belt shoe and the rear end of the conveying means. A further stop for the frontmost position of the belt shoe prevents collision with the roll casing. Nevertheless, it is possible to lift the belt shoe for up to 300 mm from the lowest position, the belt shoe and the conveying means being only slightly pivoted.

The bottom surface of the belt shoe is formed by a grid of a plurality of grid bars extending parallel to the traveling direction. The grid simultaneously serves as a holding-down means and a sliding shoe.

Preferably, it is provided that a holding-down means is respectively provided on both sides of the belt shoe at the edge facing the milling roll so that the belt shoe extends over the entire width of the milling roll.

The following is a detailed description of an embodiment of the invention with reference to the accompanying drawings.

DESCRIPTION OF THE PREFERRED EMBODIMENTS

Figure 1:
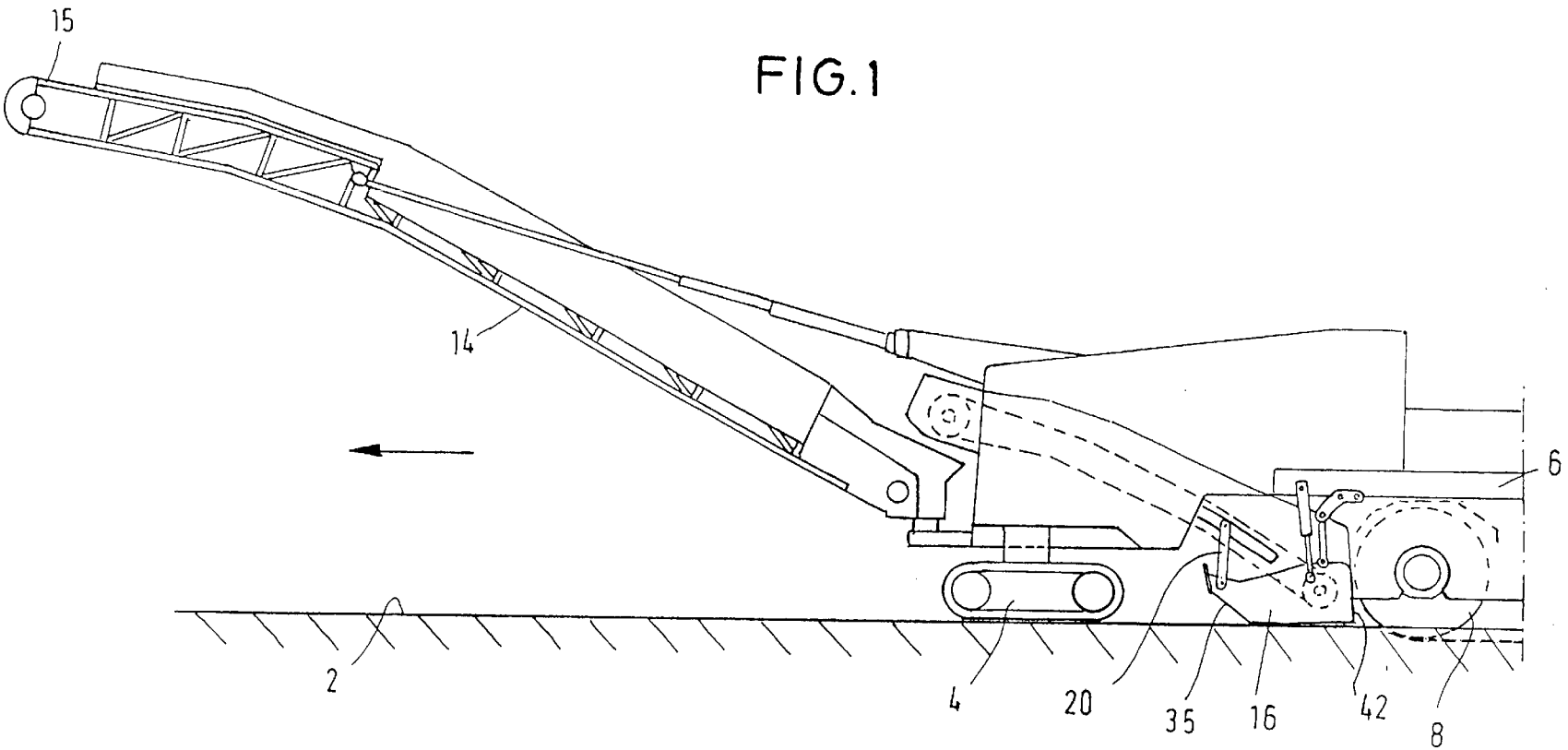
FIG. 1 illustrates a device according to the present invention for milling off ground surfaces.
Figure 2:
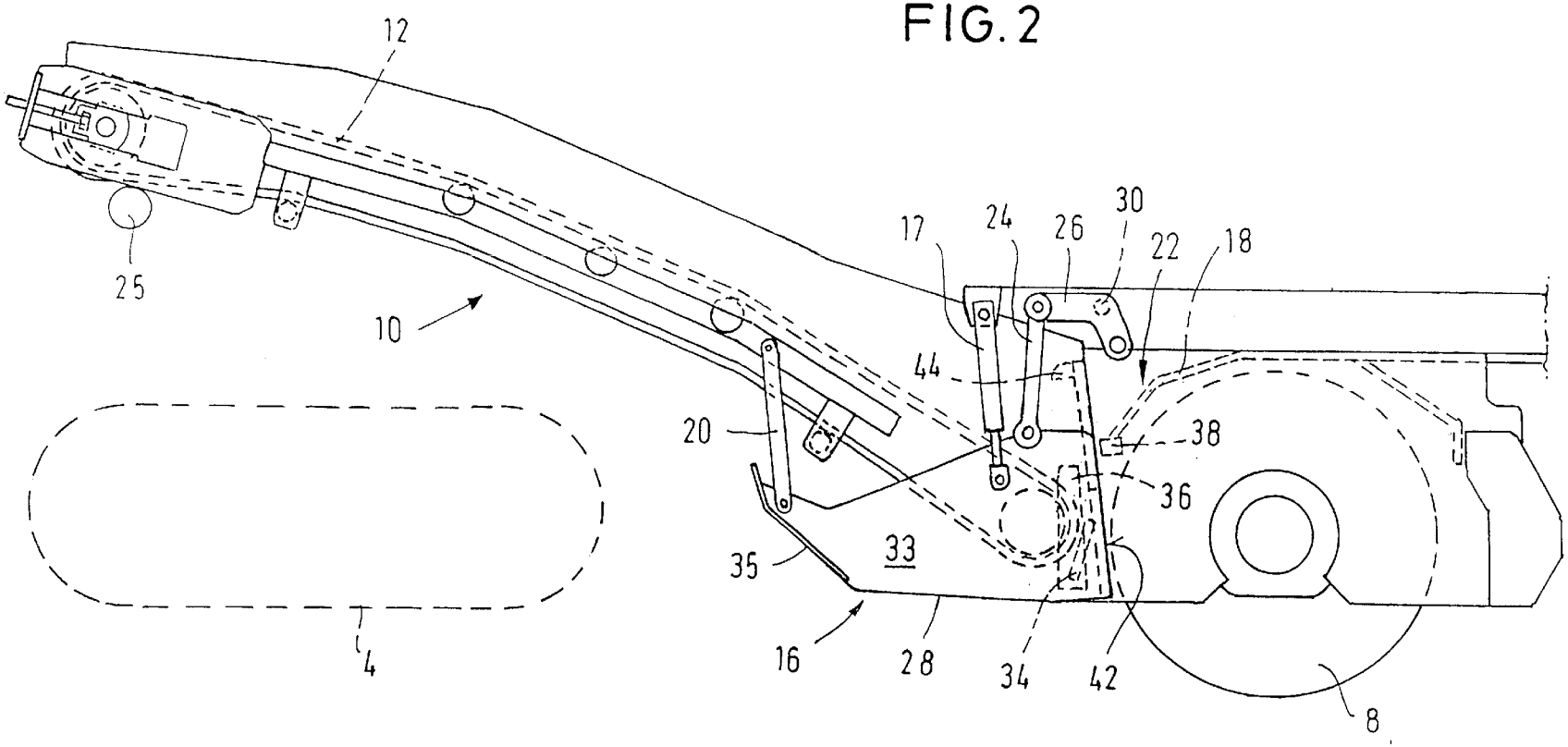
FIG. 2 is a schematic representation of the position of the belt shoe within the machine frame relative to the milling roll at maximum milling depth.
Figure 3:
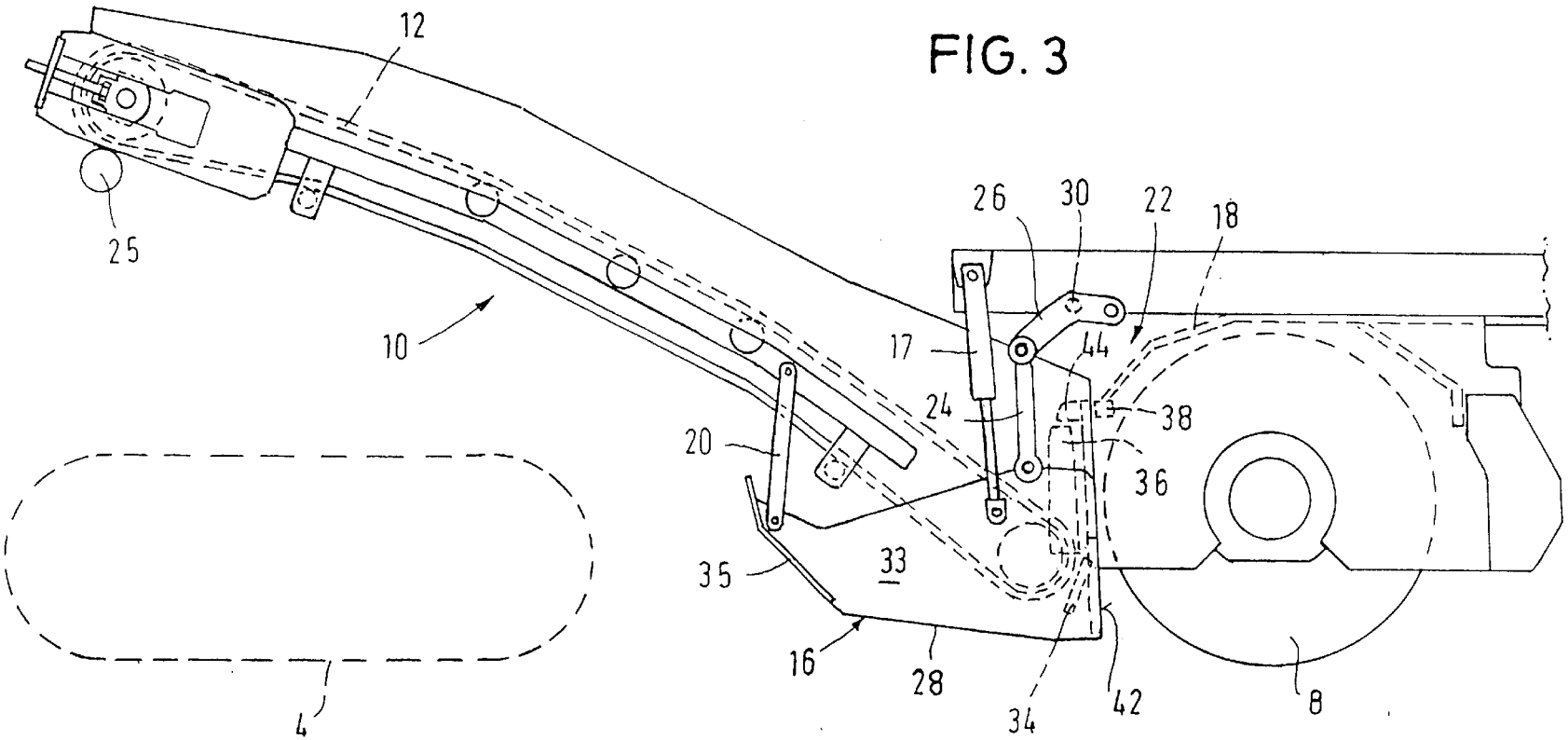
FIG. 3 shows the position of the belt shoe at minimum milling depth.

FIG. 1 illustrates a device for milling of ground surfaces 2, especially roadways of asphalt, concrete or the like, comprising a track assembly 4 supporting a machine frame 6 and a milling roll 8 supported at the machine frame 6 and extending transverse to the traveling direction of the track assembly 4. The milling depth is set through vertical adjustment of the rear wheels. Such machines are called front loader milling machines since they convey the milled off material forward in the traveling direction onto transport vehicles. Arranged in front of the milling roll 8, seen in the traveling direction, is a first conveying means 10 with a conveyor belt 12, which is disposed with an inclination in a shaft of the machine frame 6 and conveys the milled off material onto a second conveying means 14 having another conveyor belt 15. The second conveying means 14 is vertically adjustable through an adjustable inclination angle and is additionally adapted to be pivoted sideward through ±30°, for example, so that transport vehicles standing beside the track of the front loader milling machine can be loaded.

In order to transport away possibly all milled off material, the milling roll 8 is enclosed by a roll casing 18, the wall of the casing directed in the traveling direction having a passage opening 22 for the milled off material. The passage opening 22 always has the same position relative to the milling roll 8 even when the milling depth setting is altered.

The milling roll 8 is provided with helically arranged chiseling tools arranged such that the material milled off is transported to the passage opening 22 in the roll casing 18.

A belt shoe 16 is mounted to the machine frame 6 for vertical adjustment. The vertical adjustment of the belt shoe 16 is effected by a piston cylinder unit 17 mounted to the machine frame 17. Using this piston-cylinder unit, the belt shoe can be lifted in the vertical direction to surmount obstacles, for example. Here, the belt shoe 16 cannot be pushed downward, but only be lifted when desired. When the milling depth is increased, the position of the belt shoe 16 is set automatically by contact with the ground.

The belt shoe 16 accommodates the end of the conveying means 10 facing the milling roll. The support of the rear end of the conveying means 10 is a fixed point between the belt shoe 16 and the conveying means 10. On both sides of the front end of the belt shoe 16 connecting struts 20 are provided preventing the belt shoe 16 from pivoting relative to the conveying means 10.

The belt shoe 16 consists of a grid 28 extending parallel to the ground, serving as a holding-down means and a sliding shoe. The grid 28 comprises a plurality of grid bars 32 oriented in parallel to the traveling direction. At the sides, the grid 28 is limited by vertical sidewalls 33. At the rear end of the belt shoe 16, a front sheet 35 extends approximately parallel to the conveyor belt 12 of the conveying means 10. At the rear end of the belt shoe, a protective shield 34 is arranged for protecting the conveyor belt 12, preventing the conveyor belt 12 from being damaged by sharp-edged material. A shield 42, slightly inclined in the traveling direction, has a U-shaped recess in the upper portion so as to form a passage opening for the material worked off.

Figure 4:
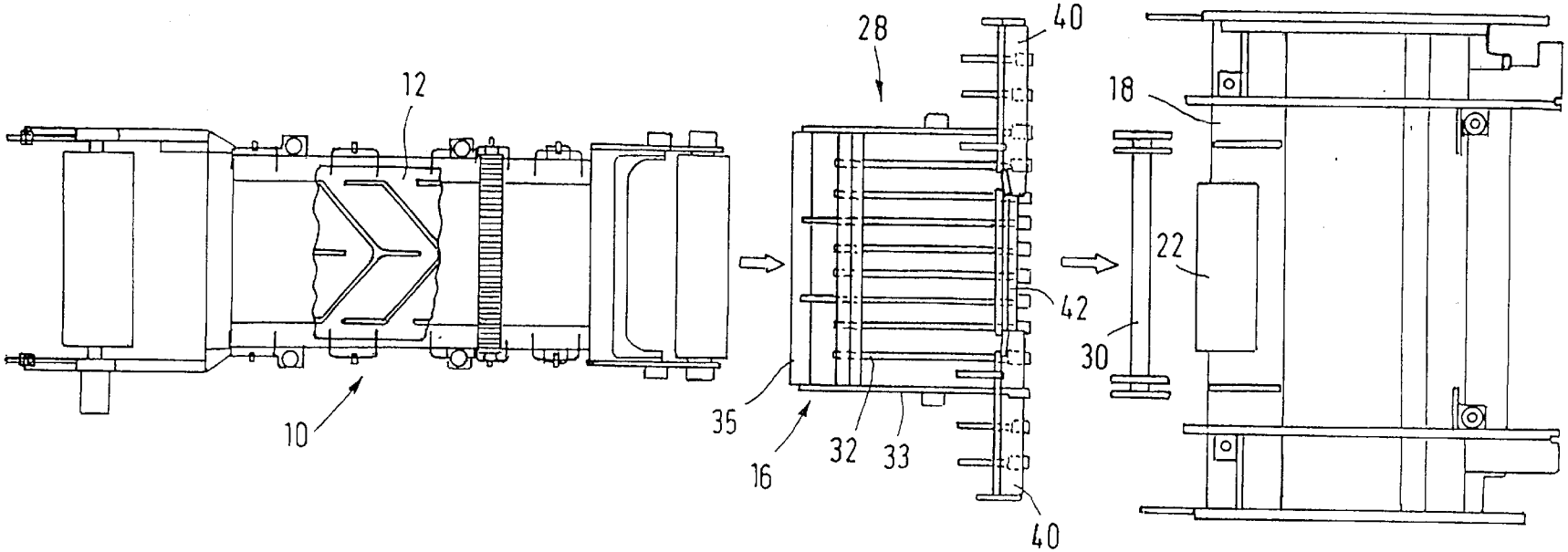
FIG. 4 is a top plan view on FIG. 1 along line IV—IV.

As illustrated best in FIG. 4, the roll casing 18 enclosing the milling roll 8 has a complementary recess and comprises a passage opening 22 for the worked off material.

One end of the piston-cylinder unit 17 is hinged to the sidewalls 33 of the belt shoe 16, while the other end is fastened to the machine frame 6. The piston-cylinder unit 17 extends substantially parallel to the connecting struts 20 and serves as a lifting means for the structural unit formed by the belt shoe 16 and the conveying means 10. Beside the piston-cylinder unit 17, a first connecting rod 24 is hinged to the sidewall 33, which is hinged to a second connecting rod 26. The second connecting rod 26 is hinged to the machine frame 6. The second connecting rod 26 is bent like a toggle lever and connected at the toggle via a linking rod 30 to the corresponding second connecting rod 26 on the other side of the belt shoe 16. The connecting rod 30 thus synchronizes the parallel guiding of the belt shoe 16 on both sides thereof. The piston-cylinder unit 17 and the connecting strut 20 are provided on both sides of the belt shoe. The parallel guiding of the belt shoe provided by the connecting rods 24, 26 makes it possible that the shield 42 pivots only very slightly, the movement being limited downward by means of a projection 44 extending in the traveling direction. At the lowest position, the projection 44 abuts a stop 36. A further stop 38 at the roll casing 18 limits the movement of the belt shoe 16 towards the milling roll 8.

The belt shoe 16 can perform an overall stroke of about 300 mm.

On both sides of the belt shoe 16, the rear edge is provided with a holding-down means 40, respectively, so that the belt shoe 16 and the holding-down means 40 on both sides of the belt shoe cover the entire width of the milling roll 8.

To remove the conveying means 10, the rear end of the conveying means 10 has to be disassembled from the belt shoe and the upper end of the connecting struts 20 have to be removed from the conveying means. In this manner, the conveying means 10 can quickly be removed from the belt shoe 16 so that repairs and maintenance can be done in short time.

Although a preferred embodiment of the invention has been specifically illustrated and described herein, it is to be understood that minor variations may be made in the apparatus without departing from the spirit and scope of the invention, as defined the appended claims.

What is claimed is:

1. A device for milling off ground surfaces (2) comprising a track assembly (4) supporting a machine frame (6), a rolling mill (8) supported in the machine frame (6) and extending transverse to the traveling direction, at least one conveying means (10) arranged in the traveling direction in front of the milling roll (8) for transporting away milled off material, a roll casing (18) housing the milling roll (8) and having a passage opening (22) for the milled off material opening toward the conveying means (10), an end of the conveying means (10) at the milling roll is supported in a belt shoe (16), means (17) for vertically adjusting the belt shoe (16) relative to the machine frame (6), and the belt shoe (16) and the conveying means (10) form a rigid unit that cannot be pivoted in relation to each other.

2. The device of claim 1, wherein the conveying means (10) is removably supported in the rear part of the belt shoe (16) that faces the milling roll (8), and wherein at least one connecting strut (20) fixes the position of the belt shoe (16) in connection with the support of the conveying means (10) relative to the conveying means (10).

3. The device of claim 1, wherein at least one piston-cylinder unit (17) is provided as a lifting means between the machine frame (6) and the belt shoe (16).

4. The device of claim 1, wherein two hingedly connected connecting rods (24, 26) guide the unit formed by the belt shoe (16) and the rear end of the conveying means (10), the first connecting rod (24) being hinged to the belt shoe (16) and the second connecting rod (26) being hinged to the machine frame (6).

5. The device of claim 4, wherein the connecting rods (24, 26) and a connecting strut (20) are provided on both sides of the belt shoe (16).

6. The device of claim 5, wherein the connecting rods (26) that are hinged to the machine frame (6), are coupled via a linking rod (30).

7. The device of claim 4, wherein the connecting rods (26) is bent in the manner of a toggle lever and the linking rod (30) is supported in the toggle area.

8. The device of claim 1, wherein the belt shoe (16) has a transverse protective shield (34) for protecting a conveyor belt (12) of the conveying means (10).

9. The device of claim 1, wherein the roll casing (18) is provided with stops (36, 38) for the lowest and/or the frontmost position of the belt shoe (16).

10. The device of claim 1, wherein the bottom side of the belt shoe (16) is formed by a grid (28) of a plurality of grid bars (32) extending in parallel to the traveling direction.

11. The device of claim 1, wherein a holding-down means (40) that extends over the entire width of the rolling mill (8) is provided on the bottom surface of the belt shoe (16) at the edge facing the milling roll (8).

12. A device for milling ground surfaces comprising a track assembly supporting a machine frame, a rolling mill supported in the machine frame and extending transverse to the traveling direction, at least one conveying means arranged in the traveling direction in front of the milling roll for conveying away milled off material, a roll casing housing the milling roll and having a passage opening for the milled off material opening toward an entrance end of the conveying means; a belt shoe defined in part by forward and rear ends and opposite side walls; said conveying means entrance end being located between said belt shoe opposite side walls adjacent said casing housing passage opening for receiving milled off material therefrom, said belt shoe and conveying means forming a substantially rigid unit that cannot be pivoted relative to each other, means for variably vertically adjusting said rigid unit relative to said machine frame, and linkage means at opposite sides of said machine frame for pivotally connecting said machine frame to said belt shoe opposite side walls.

13. The device as defined in claim 12 wherein said belt shoe includes an opening at said rear end through which milled off material passes incident to being deposited upon said conveyor means entrance end.

14. The device as defined in claim 13 wherein each of said linkage means includes a pair of links, a first end of each first link being pivotally connected to an associated belt shoe side wall, a first end of each second link being pivotally connected to said machine frame, and second ends of said first and second links being pivotally connected to each other.

15. The device as defined in claim 14 including means for connecting at least one of said first and second links of one pair of links with at least one of said first and second links of the other of the pair of links.

16. The device as defined in claim 12 wherein said belt shoe includes a recess in a rear plate at said rear end through which milled off material passes incident to being deposited upon said conveyor means entrance end.

17. The device as defined in claim 16 wherein each of said linkage means includes a pair of links, a first end of each first link being pivotally connected to an associated belt shoe side wall, a first end of each second link being pivotally connected to said machine frame, and second ends of said first and second links being pivotally connected to each other.

18. The device as defined in claim 17 including means for connecting at least one of said first and second links of one pair of links with at least one of said first and second links of the other of the pair of links.

19. The device as defined in claim 12 wherein each of said linkage means includes a pair of links, a first end of each first link being pivotally connected to an associated belt shoe side wall, a first end of each second link being pivotally connected to said machine frame, and second ends of said first and second links being pivotally connected to each other.

20. The device as defined in claim 19 including means for connecting at least one of said first and second links of one pair of links with at least one of said first and second links of the other of the pair of links.

21. A device for milling off ground surfaces (2) comprising a track assembly (4) supporting a machine frame (6), a rolling mill (8) supported in the machine frame (6) and extending transverse to the traveling direction, at least one conveying means (10) arranged in the traveling direction in front of the milling roll (8) for transporting away milled off material, a roll casing (18) housing the milling roll (8) and having a passage opening (22) for the milled off material opening toward the conveying means (10), an end of the conveying means (10) at the milling roll being supported in a belt shoe (16), means (17) for vertically adjusting the belt shoe (16) relative to the machine frame (6), the belt shoe (16) and the conveying means (10) forming a rigid unit that cannot be pivoted in relation to each other, two hingedly connected rods (24, 26) for guiding the rigid unit formed by the belt shoe (16) and the rear end of the conveying means (10), a first (24) of the connecting rods being hinged to the belt shoe (16), and a second (26) of the connecting rods being hinged to the machine frame (6).

22. The device as defined in claim 21 wherein the connecting rods (24, 26) are provided on both sides of the belt shoe (16).

23. The device as defined in claim 22 including means connecting the connecting rods (24, 26) on opposite sides of the belt shoe (16) to each other.

* * * * *